US011205830B1

(12) United States Patent
Lin et al.

(10) Patent No.: US 11,205,830 B1
(45) Date of Patent: Dec. 21, 2021

(54) POWER DIVIDER

(71) Applicant: National Chi Nan University, Puli (TW)

(72) Inventors: Yo-Sheng Lin, Puli (TW); Kai-Siang Lan, Puli (TW)

(73) Assignee: National Chi Nan University, Puli (TW)

( * ) Notice: Subject to any disclaimer, the term of this patent is extended or adjusted under 35 U.S.C. 154(b) by 0 days.

(21) Appl. No.: 17/124,272

(22) Filed: Dec. 16, 2020

(30) Foreign Application Priority Data

Aug. 25, 2020 (TW) ..... 109128978

(51) Int. Cl.
*H01P 5/12* (2006.01)
*H01P 3/00* (2006.01)

(52) U.S. Cl.
CPC ..... *H01P 5/12* (2013.01); *H01P 3/003* (2013.01)

(58) Field of Classification Search
CPC ..... H01P 5/12; H01P 3/003
See application file for complete search history.

(56) References Cited

U.S. PATENT DOCUMENTS 5,650,756 A * 7/1997 Hayashi ..... H01G 4/40 333/100
6,005,454 A * 12/1999 Kim ..... H01P 5/16 333/128

FOREIGN PATENT DOCUMENTS

CN 105514562 A * 4/2016
CN 108493551 A * 9/2018
KR 100529581 B1 * 11/2005
KR 20100004440 A * 1/2010

* cited by examiner

*Primary Examiner* — Robert J Pascal
*Assistant Examiner* — Kimberly E Glenn
(74) *Attorney, Agent, or Firm* — Akerman LLP; Peter A. Chiabotti

(57) ABSTRACT

A power divider includes two transmission lines (TLs), two capacitors and a resistor. Each TL has a first terminal, a second terminal, and a length that is 0.07 to 0.12 times an operation wavelength in the power divider. The TLs establish electromagnetic coupling therebetween. The first terminals of the TLs are connected together, and are to receive an input signal. One of the capacitors is connected to a common node of the TLs. The other capacitor and the resistor are connected in parallel between the second terminals of the TLs. The second terminals of the TLs are to respectively provide two output signals which are in-phase, and each of which has a frequency equal to that of the input signal.

10 Claims, 9 Drawing Sheets

POWER DIVIDER

CROSS-REFERENCE TO RELATED APPLICATION

This application claims priority of Taiwanese Patent Application No. 109128978, filed on Aug. 25, 2020.

FIELD

The disclosure relates to power dividing techniques, and more particularly to a power divider.

BACKGROUND

Referring to FIGS. 1 and 2, a power divider is configured to operate at an operation frequency that corresponds to an operation wavelength of λ of the power divider. The power divider is to receive an input signal (P1), and divides the input signal (P1) into two output signals (P2, P3) each with a power half that of the input signal (P1) and a frequency equal to that of the input signal (P1).

A first conventional power divider as shown in FIG. 1 is a distributed Wilkinson power divider that includes two transmission lines 11, 12, each with a physical length of λ/4. However, the conventional distributed power divider circuit occupies a large area.

A second conventional power divider as shown in FIG. 2 is a lumped-distributed Wilkinson power divider that includes not only two transmission lines 18, 19, each with a physical length of about A/8, but also four capacitors 13, 14, 15, and 16. The conventional lumped-distributed power divider circuit also occupies a large area.

SUMMARY

Therefore, an object of the disclosure is to provide a power divider that can alleviate the drawback of the prior arts.

According to the disclosure, the power divider is configured to operate at an operation frequency, and includes a first transmission line, a second transmission line, a first capacitor, a second capacitor and a resistor. The first transmission line has a first terminal, a second terminal, and a physical length that is 0.07 to 0.12 times an operation wavelength of the power divider. The operation wavelength of the power divider corresponds to the operation frequency. The second transmission line has a first terminal, a second terminal, and a physical length that is 0.07 to 0.12 times the operation wavelength of the power divider. The second transmission line is disposed adjacent to and spaced apart from the first transmission line so as to establish electromagnetic coupling with the first transmission line. The first terminals of the first and second transmission lines are connected together, and are to receive an input signal. The first capacitor has a first terminal that is connected to the first terminals of the first and second transmission lines, and a second terminal. The second capacitor and the resistor are connected in parallel between the second terminals of the first and second transmission lines. The second terminals of the first and second transmission lines are to respectively provide two output signals which are in-phase, and each of which has a frequency equal to that of the input signal.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
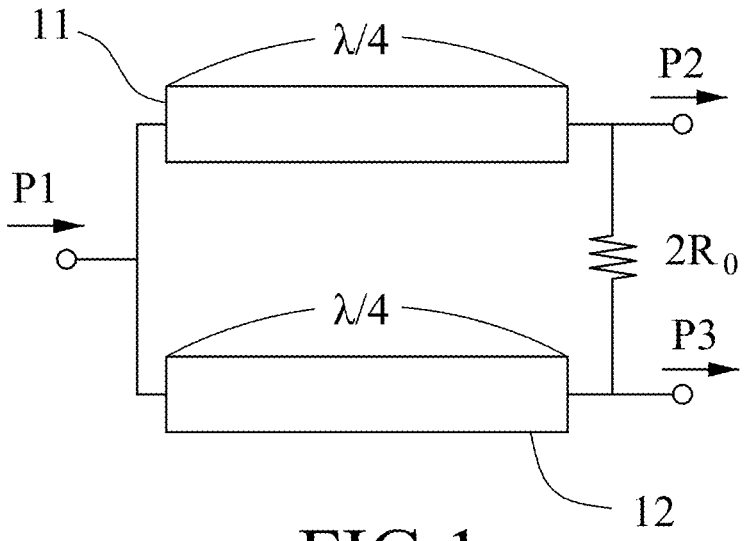
FIG.1 PRIOR ART
FIG. 1 is a circuit diagram illustrating a first conventional power divider.
Figure 2:
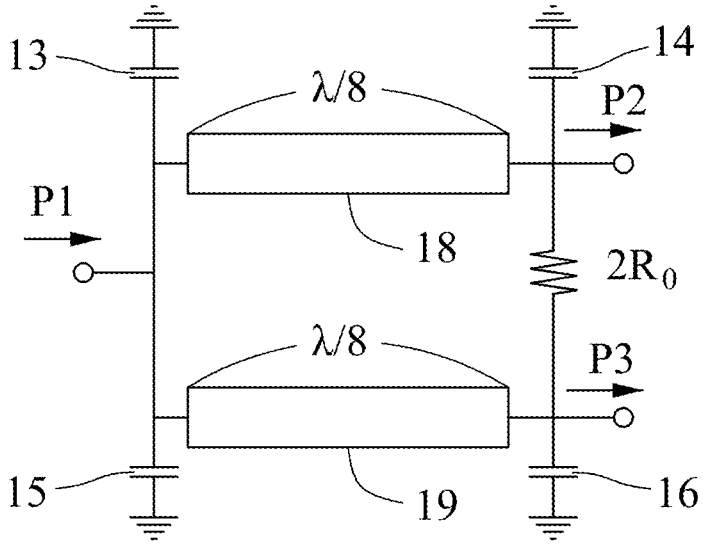
FIG.2 PRIOR ART
FIG. 2 is a circuit diagram illustrating a second conventional power divider.
Figure 3:
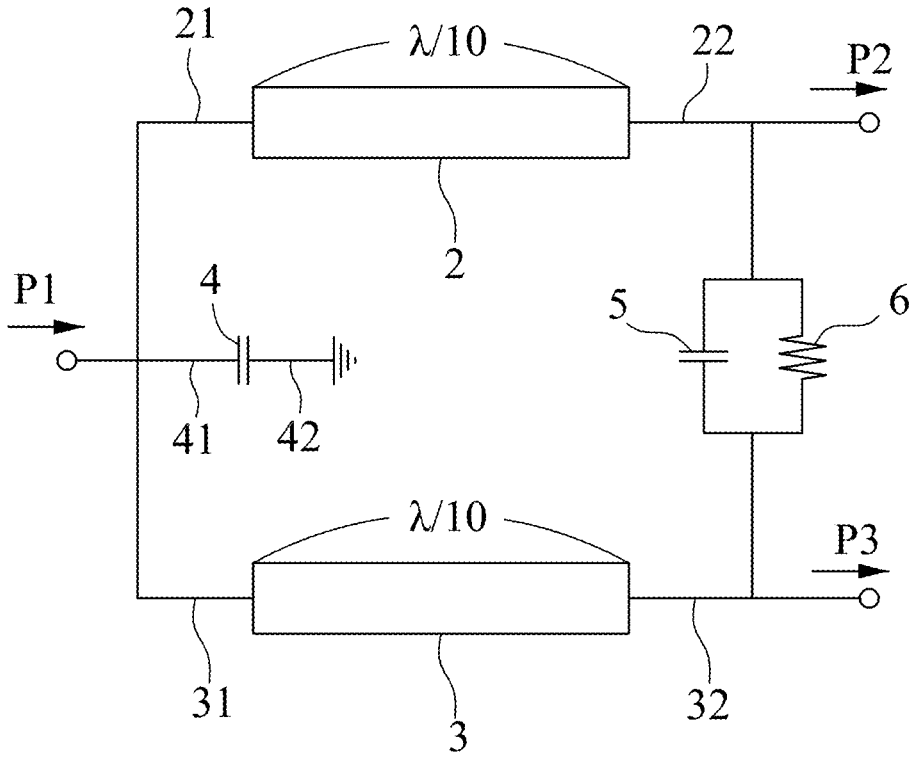
FIG. 3 is a circuit diagram illustrating an embodiment of a power divider according to the disclosure.

Referring to FIG. 3, an embodiment of a power divider according to the disclosure is a lumped-distributed Wilkinson power divider, is configured to operate at an operation frequency of $f_0$, and includes a first transmission line 2, a second transmission line 3, a first capacitor 4, a second capacitor 5 and a resistor 6.

The first transmission line 2 has a first terminal 21, a second terminal 22, and a physical length that is 0.07 to 0.12 times an operation wavelength of λ of the power divider. The operation wavelength (λ) of the power divider corresponds to the operation frequency ($f_0$), and is different from the operation wavelength of $\lambda_0$ in vacuum (i.e., $\lambda_0$ is $3\times10^8/f_0$ meters).

The second transmission line 3 has a first terminal 31, a second terminal 32, and a physical length that is 0.07 to 0.12 times the operation wavelength (λ) of the power divider. The second transmission line 3 is disposed adjacent to and spaced apart from the first transmission line 2 so as to establish electromagnetic coupling with the first transmission line 2. The first and second transmission lines 2, 3 have the same physical length in this embodiment, but the disclosure is not limited thereto.

The first terminals 21, 31 of the first and second transmission lines 2, 3 are connected together, and are to receive an input signal (P1).

The first capacitor 4 has a first terminal 41 that is connected to the first terminals 21, 31 of the first and second transmission lines 2, 3, and a second terminal 42 that is connected to a reference node, which is ground in this embodiment.

The second capacitor 5 and the resistor 6 are connected in parallel between the second terminals 22, 32 of the first and second transmission lines 2, 3. In this embodiment, the first capacitor 4 has a capacitance twice that of the second capacitor 5.

The second terminals 22, 32 of the first and second transmission lines 2, 3 are to respectively provide two output signals (P2, P3) which are in-phase, and each of which has a frequency equal to that of the input signal (P1).

In this embodiment, a characteristic impedance ($Z_T$) of each of the first and second transmission lines 2, 3 can be expressed by the following equation:

$$Z_T = R_0 \cdot \frac{\sqrt{1+\sin^2\theta}}{\sin\theta}, \quad \text{Equation 1}$$

where $R_0$ denotes half a resistance of the resistor 6, and is 50Ω in this embodiment, and where θ denotes an electrical length of the corresponding one of the first and second transmission lines 2, 3. In this embodiment, for each of the first and second transmission lines 2, 3, the electrical length (θ) is 360° when the physical length of the transmission line 2 or 3 is λ, and the electrical length (θ) is 36° when the physical length of the transmission line 2 or 3 is λ/10.

In addition, a capacitance ($C_{P2}$) of the second capacitor 5 can be expressed by the following equation:

$$C_{P2} = \frac{\cos\theta}{2 \cdot R_0 \cdot \omega_0 \cdot \sqrt{1+\sin^2\theta}}, \quad \text{Equation 2}$$

where $\omega_0$ denotes an operating angular frequency corresponding to the operation frequency ($f_0$), i.e., $\omega_0 = 2\pi \cdot f_0$.

In a scenario where the first and second transmission lines 2, 3 are lossless, a scattering parameter matrix of the power divider of this embodiment can be expressed by the following equation.

$$[S] = \begin{bmatrix} S_{11} & S_{12} & S_{13} \\ S_{21} & S_{22} & S_{23} \\ S_{31} & S_{32} & S_{33} \end{bmatrix} = \frac{1}{\sqrt{2}} \begin{bmatrix} 0 & e^{-j\tan^{-1}\sqrt{1+2\tan^2\theta}} & e^{-j\tan^{-1}\sqrt{1+2\tan^2\theta}} \\ e^{-j\tan^{-1}\sqrt{1+2\tan^2\theta}} & 0 & 0 \\ e^{-j\tan^{-1}\sqrt{1+2\tan^2\theta}} & 0 & 0 \end{bmatrix} \quad \text{Equation 3}$$

According to Equation 3, a reflection coefficient (i.e., $S_{11}$) at an input port of the power divider (i.e., a common node of the first and second transmission lines 2, 3) is zero. A reflection coefficient (i.e., $S_{22}$) at a first output port of the power divider (i.e., the second terminal 22 of the first transmission line 2) is zero. A reflection coefficient (i.e., $S_{33}$) at a second output port of the power divider (i.e., the second terminal 32 of the second transmission line 3) is zero. An isolation between the first and second output ports is infinite since $S_{23}=S_{32}=0$. A gain (i.e., $|S_{21}|$) between the input port and the first output port is $1/\sqrt{2}$ (i.e., −3 dB), and a phase shift between the input port and the first output port is $-\tan^{-1}\sqrt{1+2\tan^2\theta}$, which is −55.1° (i.e., a phase at the first output port is smaller than a phase at the input port by 55.1°) when the electrical length (θ) of each of the first and second transmission lines 2, 3 is 36°. A gain (i.e., $|S_{31}|$) between the input port and the second output port is $1/\sqrt{2}$ (i.e., −3 dB), and a phase shift between the input port and the second output port is $-\tan^{-1}\sqrt{1+2\tan^2\theta}$, which is −55.1° (i.e., a phase at the second output port is smaller than the phase at the input port by 55.1°) when the electrical length (θ) of each of the first and second transmission lines 2, 3 is 36°.

According to Equations 1 and 2, shorter physical lengths (i.e., smaller electrical lengths) of the first and second transmission lines 2, 3 lead to larger characteristic impedances ($Z_T$) of the first and second transmission lines 2, 3 and a larger capacitance ($C_{P2}$) of the second capacitor 5. However, it is difficult to implement the first and second transmission lines 2, 3 with characteristic impedances ($Z_T$) far larger than 100Ω while maintaining low power losses when the power divider is fabricated using a semiconductor process. The electrical length (θ) of each of the first and second transmission lines 2, 3 is 35.3° when the characteristic impedance ($Z_T$) of the same is 100Ω. The capacitance ($C_{P2}$) of the second capacitor 5 is 34.1 fF when the electrical length (θ) of each of the first and second transmission lines 2, 3 is 35.3° and the operation frequency ($f_0$) is 33 GHz. Therefore, the physical length of each of the first and second transmission lines 2, 3 is limited to being in the range of from 0.07·λ to 0.12·λ (i.e., the electrical length (θ) lies within the range of from 25.2° to 43.2°) so as to occupy less area and achieve decent performance of the power divider.

Figure 4:
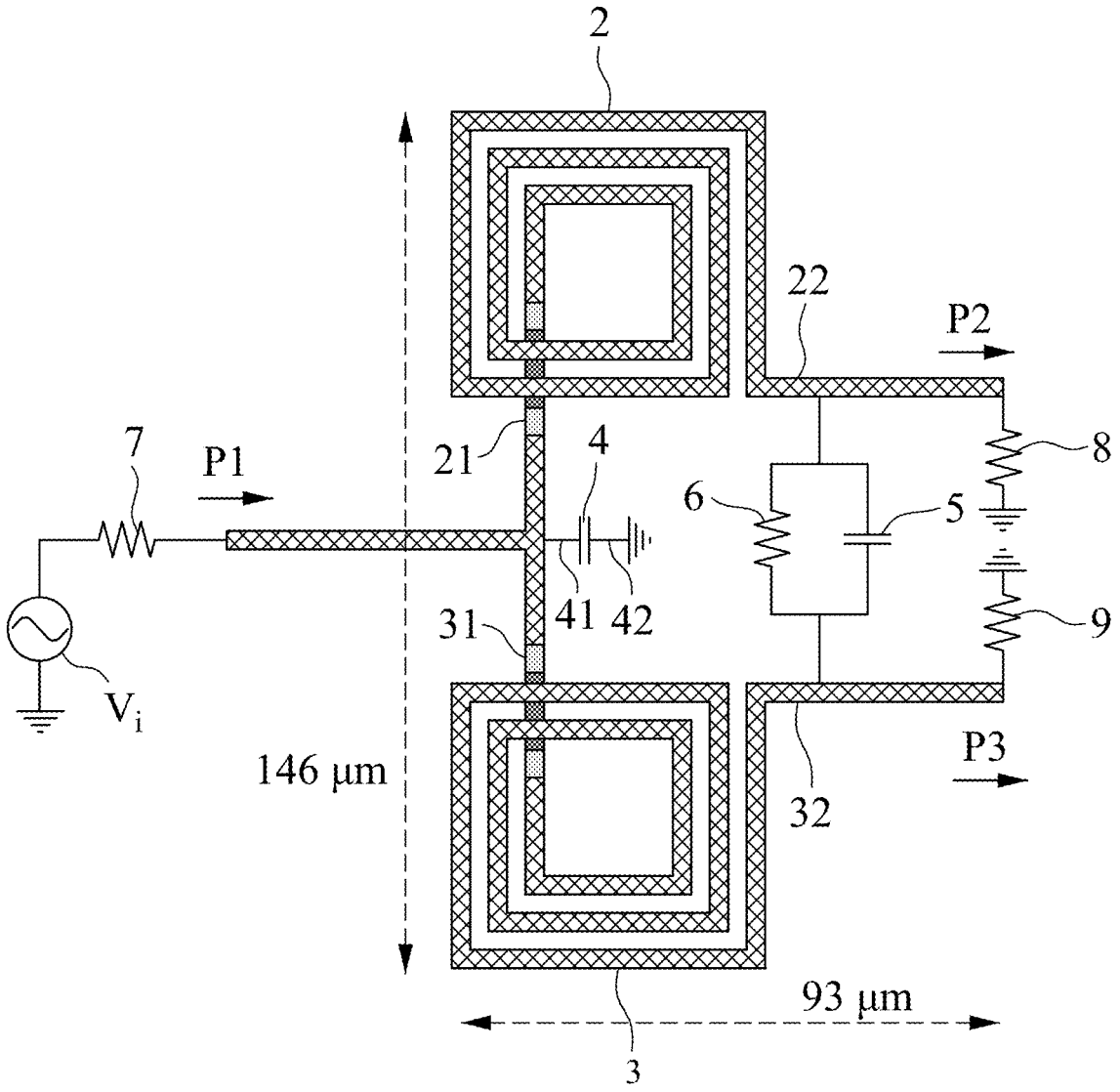
FIG. 4 is a schematic diagram illustrating a first implementation of the embodiment.

FIG. 4 illustrates a first implementation of the power divider of this embodiment. In the first implementation, the operation frequency ($f_0$) is 33 GHz. The power divider is fabricated using a commercial 0.18 μm complementary metal oxide semiconductor (CMOS) process with a substrate resistivity of 10 Ω·cm and a top metal thickness of 2.34 μm. The first and second transmission lines 2, 3 are substantially coplanar, are formed mainly in a predetermined metal layer (e.g., a top metal layer), and are line-symmetrical with each other. Each of the first and second transmission lines 2, 3 has a physical length of 473 μm (i.e., the electrical length (θ) is 34.5°) and a width of 4 μm, and is configured as a rectangular spiral with a turn number of 2.75 and a turn-to-turn distance of 2 μm. It should be noted that the first and second transmission lines 2, 3 have the same width in this implementation, but may have different widths (e.g., the width of the first transmission line 2 is greater than that of the second transmission line 3) in other implementations to allow higher flexibility in the design of the power divider. The capacitances ($2 \cdot C_{P2}$, $C_{P2}$) of the first and second capacitors 4, 5 are respectively 70.3 fF and 35.8 fF, which are respectively close to the theoretical values of 69.2 fF and 34.6 fF obtained according to Equation 2. In this embodiment, the first implementation of the power divider occupies an area of $0.01=^2$ (i.e., $1.2\times10^{-4}\lambda_0^2$).

Figure 5:
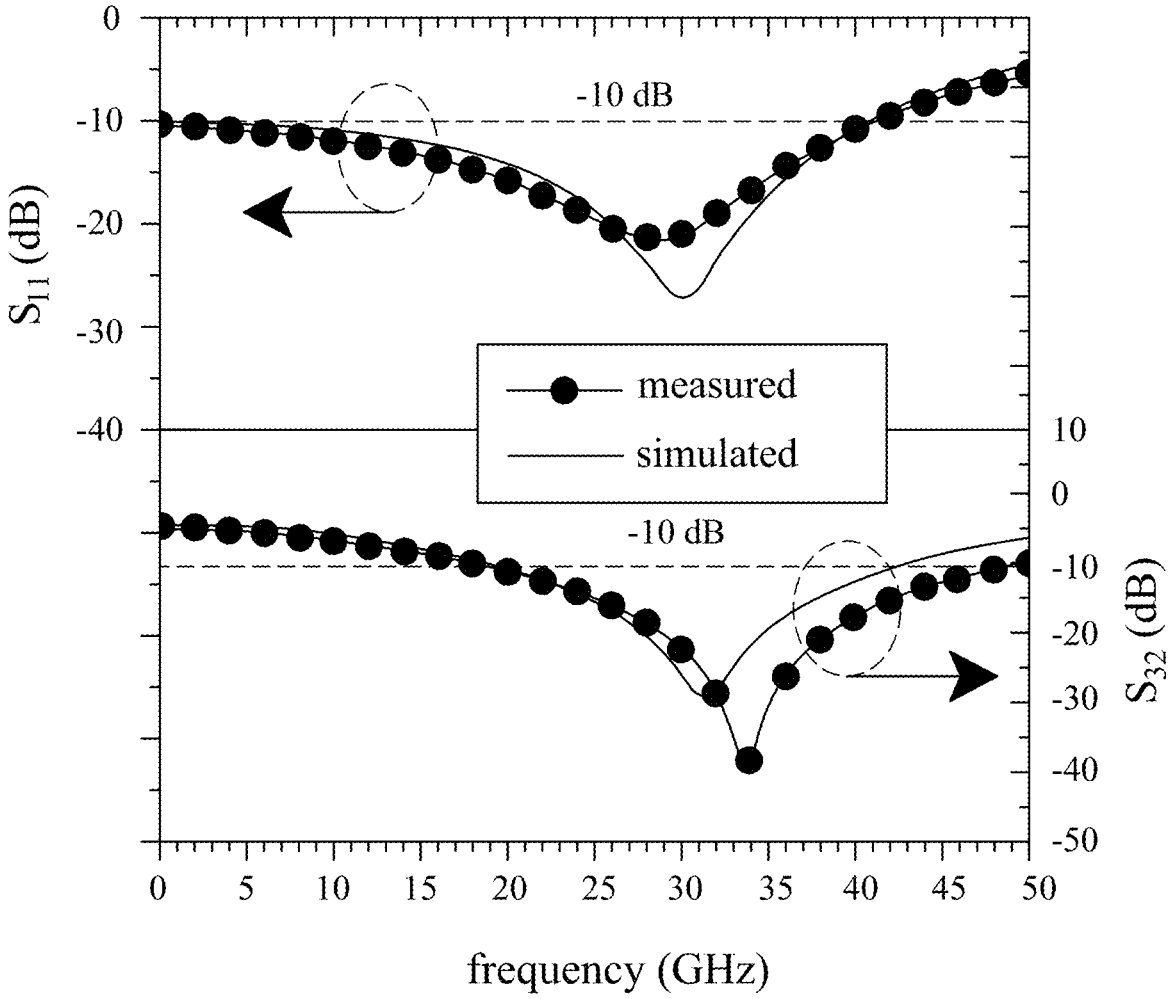
FIG. 5 is a plot illustrating simulated and measured scattering parameters of the first implementation.

FIG. 5 illustrates simulated and measured scattering parameters ($S_{11}$, $S_{32}$) of the first implementation in a scenario where the frequency of the input signal (P1) (see FIG. 4) falls within a range of from 0 GHz to 50 GHz. Referring to FIGS. 4 and 5, the input signal (P1) is fed from a signal source ($V_i$) to the input port via an input resistor 7. The output signal (P2) is output from the first output port to a first output resistor 8. The output signal (P3) is output from the second output port to a second output resistor 9. The scattering parameters ($S_{11}$, $S_{32}$) are measured using a network analyzer (e.g., Agilent N5245A). It can be reasonably determined from FIG. 5 that the measured scattering parameters ($S_{11}$, $S_{32}$) are consistent with the simulated counterparts. For instance, the measured scattering parameter ($S_{11}$), which is the measured reflection coefficient at the input port, is −17.8 dB when the frequency of the input signal (P1) is 33 GHz, and is −10 dB or lower when the frequency of the input signal (P1) falls within a range of from 0 GHz to 41.4 GHz. That is, the bandwidth corresponding to the measured scattering parameter ($S_{11}$) being −10 dB or lower (also referred to as the −10 dB matching bandwidth) is 41.4 GHz. The measured scattering parameter ($S_{32}$), which corresponds to the measured isolation between the first and second output ports, is −34.7 dB when the frequency of the input signal (P1) is 33 GHz, and is −10 dB or lower when the frequency of the input signal (P1) falls within a range of from 18.9 GHz to 48.5 GHz. That is, the bandwidth corresponding to the measured scattering parameter ($S_{32}$) being −10 dB or lower (also referred to as the −10 dB isolation bandwidth) is 29.6 GHz. It should be noted that the measured scattering parameters ($S_{11}$, $S_{32}$) are excellent when the frequency of the input signal (P1) is 33 GHz.

Figure 6:
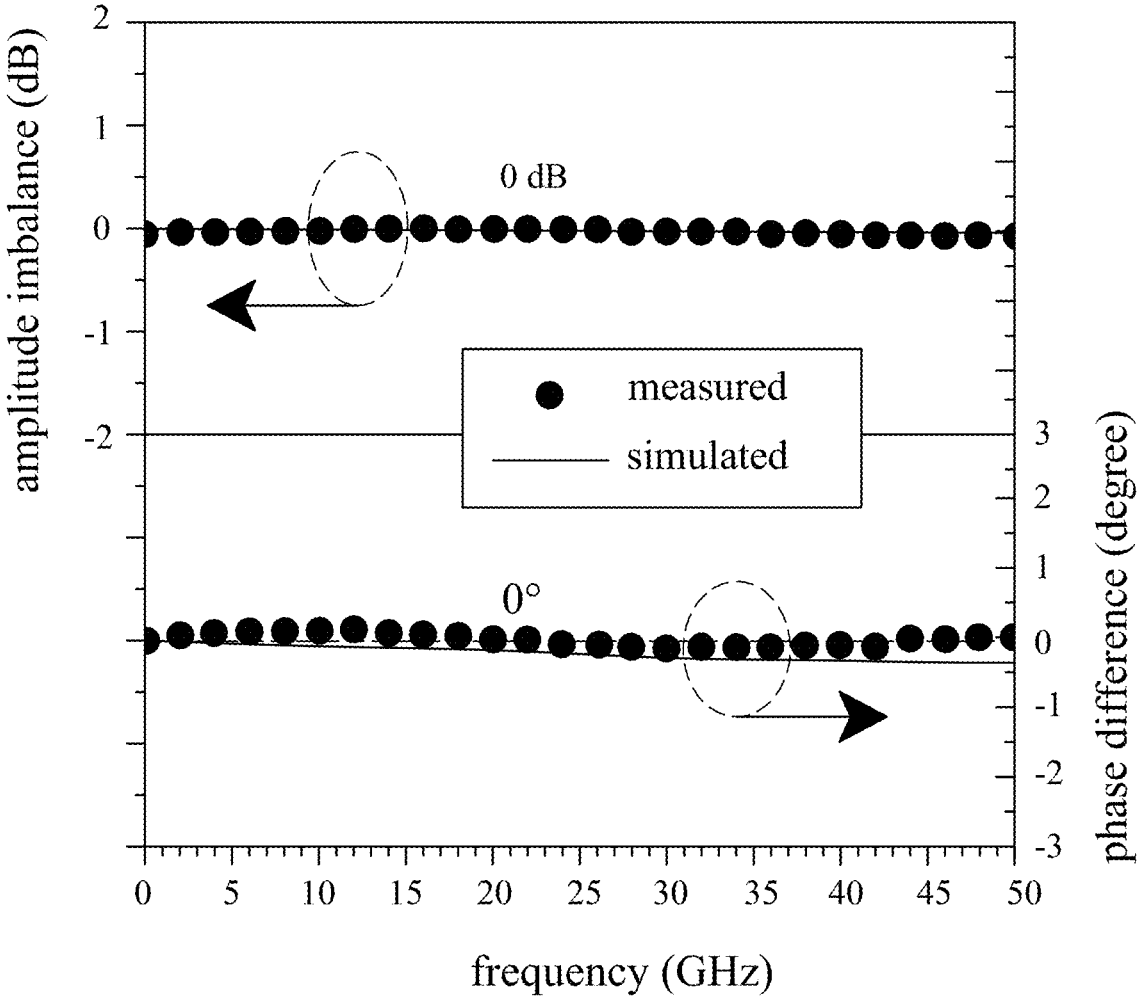
FIG. 6 is a plot illustrating simulated and measured amplitude imbalance and phase difference of the first implementation.

FIG. 6 illustrates simulated and measured amplitude imbalance (i.e., $|S_{21}|-|S_{31}|$) and phase difference (i.e., $\angle S_{21}-\angle S_{31}$) of the first implementation in a scenario where the frequency of the input signal (P1) (see FIG. 4) falls within a range of from 0 GHz to 50 GHz. It can be reasonably determined from FIG. 6 that the measured amplitude imbalance and phase difference are consistent with the simulated counterparts. In this plot, the measured amplitude imbalance falls within a range of from −0.05 dB to 0 dB and the measured phase difference falls within a range of from −0.1° to 0.21° when the frequency of the input signal (P1) (see FIG. 4) falls within a range of from 0 GHz to 40 GHz. That is, the output signals (P2, P3) (see FIG. 4) are substantially in-phase, and have substantially equal power. The excellent amplitude imbalance and phase difference performances are attributed to the symmetrical layout of the first and second transmission lines 2, 3.

Figure 7:
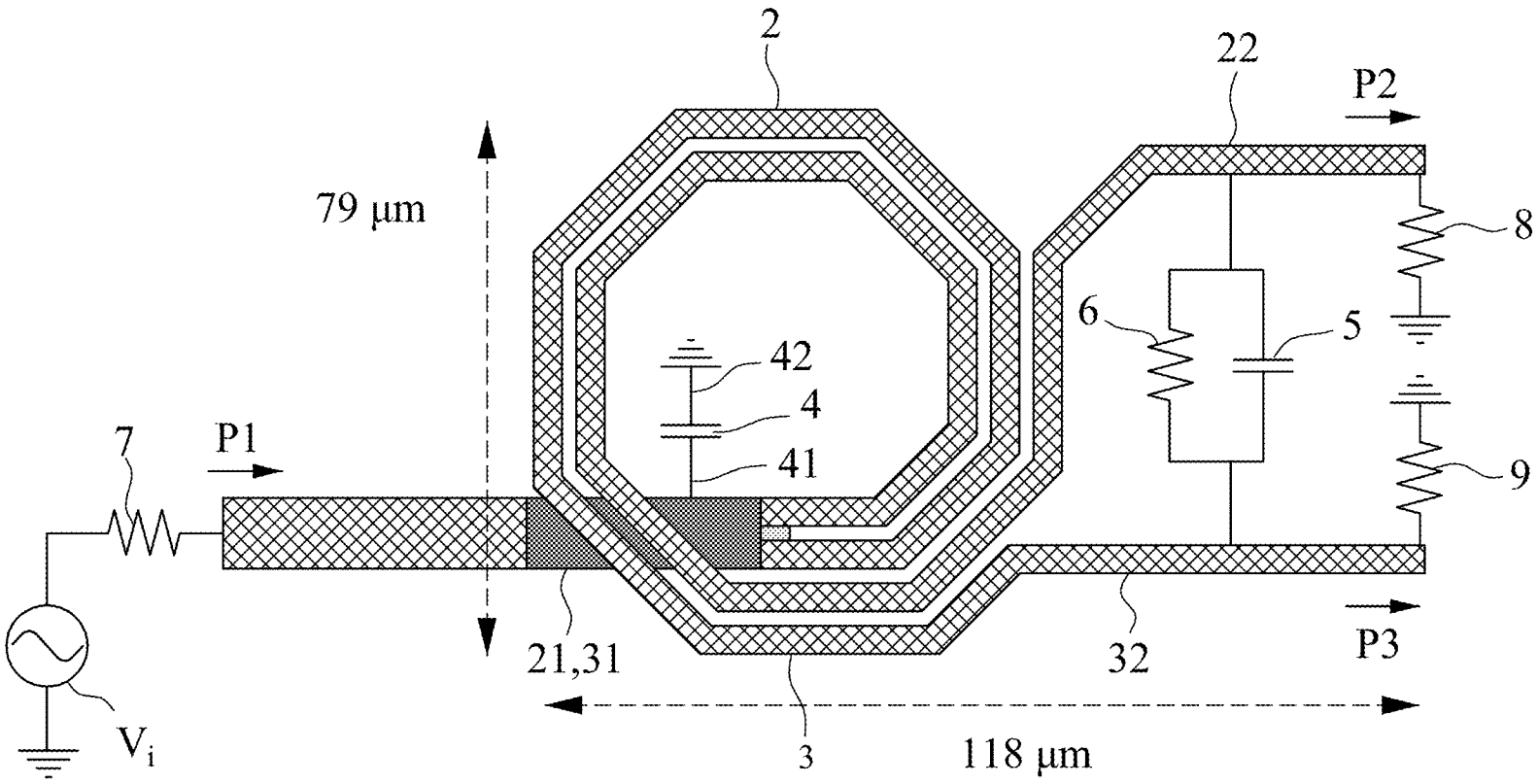
FIG. 7 is a schematic diagram illustrating a second implementation of the embodiment.

FIG. 7 illustrates a second implementation of the power divider of this embodiment. The second implementation is similar to the first implementation, but differs from the first implementation in that: (a) the operation frequency ($f_0$) is 28 GHz; (b) the first and second transmission lines 2, 3 are interwound together with a line-to-line distance of 2 μm; (c) each of the first and second transmission lines 2, 3 has a physical length of 261 μm, and is configured as an octagonal spiral with a turn number of 1.3; (d) the capacitances ($2\cdot C_{P2}$, $C_{P2}$) of the first and second capacitors 4, 5 are respectively 87 fF and 43.5 fF, which are respectively close to the theoretical values of 86.8 fF and 43.4 fF obtained according to Equation 2; and (e) the power divider occupies an area of $0.093^{=2}$, which is smaller than that in the first implementation.

Figure 8:
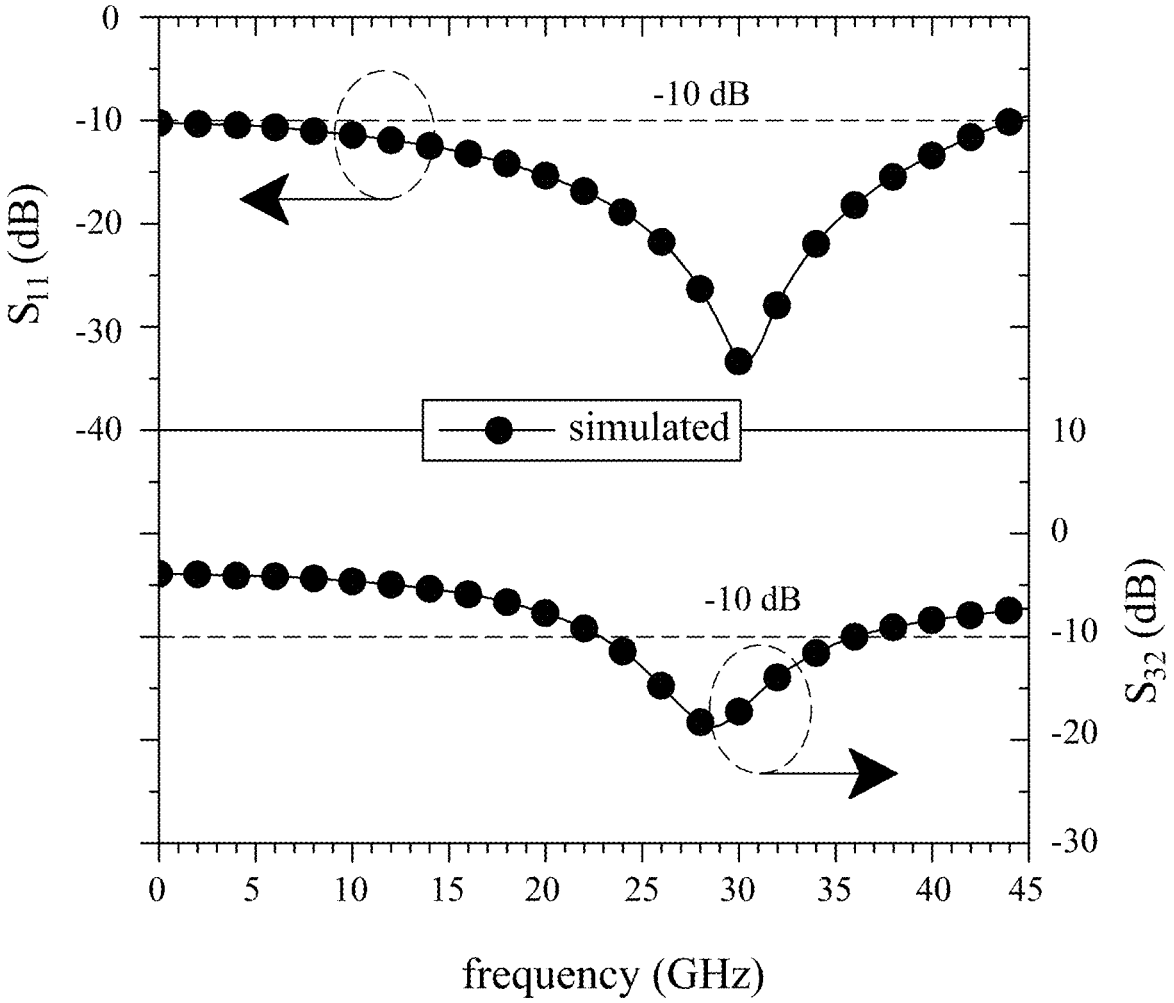
FIG. 8 is a plot illustrating simulated scattering parameters of the second implementation.

FIG. 8 illustrates simulated scattering parameters ($S_{11}$, $S_{32}$) of the second implementation in a scenario where the frequency of the input signal (P1) (see FIG. 7) falls within a range of from 0 GHz to 45 GHz. According to FIG. 8, the simulated scattering parameter ($S_{11}$) is −26.3 dB when the frequency of the input signal (P1) (see FIG. 7) is 28 GHz, and is −10 dB or lower when the frequency of the input signal (P1) (see FIG. 7) falls within a range of from 0 GHz to 44.3 GHz. That is, the −10 dB matching bandwidth is 44.3 GHz. The simulated scattering parameter ($S_{32}$) is −18.3 dB when the frequency of the input signal (P1) (see FIG. 7) is 28 GHz, and is smaller than −10 dB when the frequency of the input signal (P1) (see FIG. 7) falls within a range of 22.8 GHz to 36.1 GHz. That is, the −10 dB isolation bandwidth is 13.3 GHz.

Figure 9:
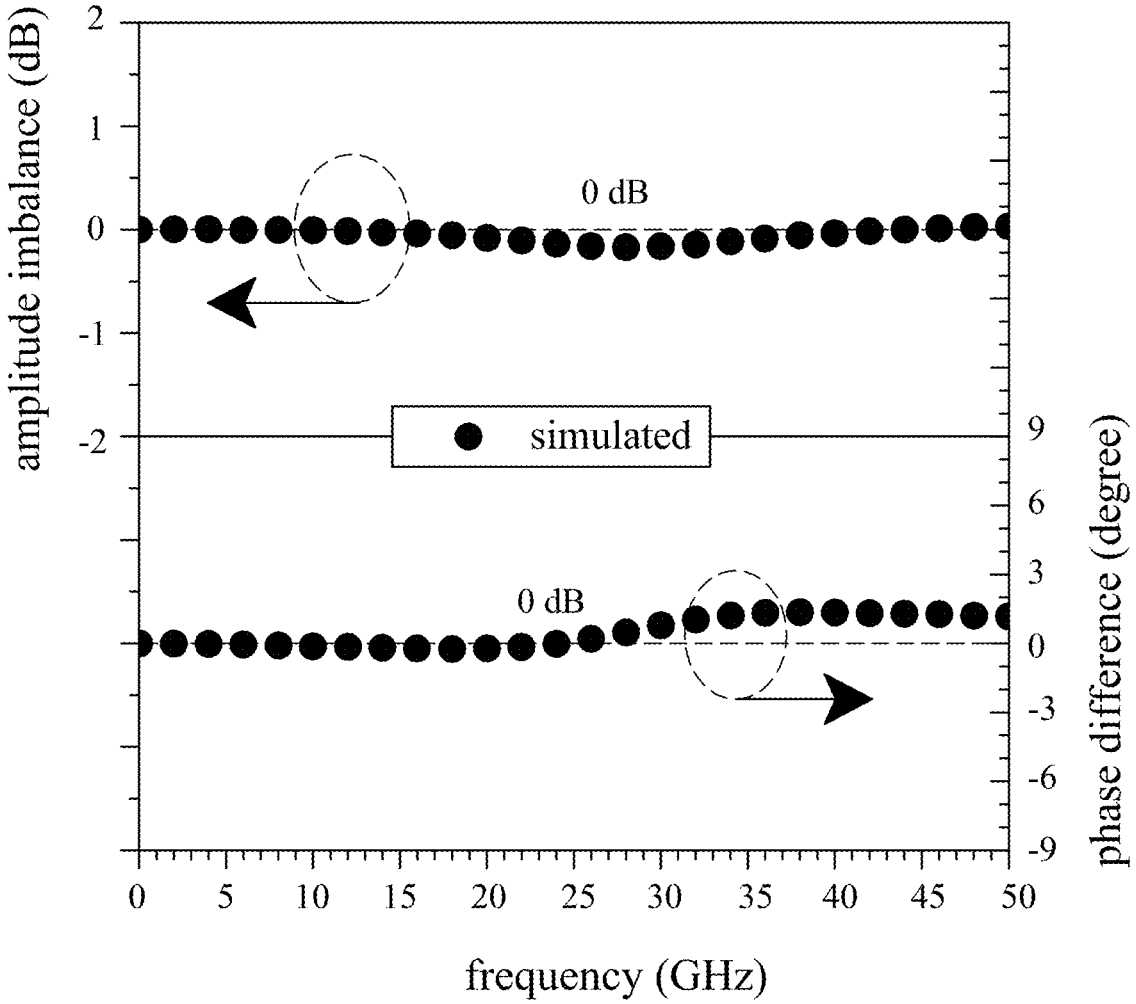
FIG. 9 is a plot illustrating simulated amplitude imbalance and phase difference of the second implementation.

FIG. 9 illustrates simulated amplitude imbalance and phase difference of the second implementation in a scenario where the frequency of the input signal (P1) (see FIG. 7) falls within a range of from 0 GHz to 50 GHz. The simulated amplitude imbalance falls within a range of from −0.16 dB to 0 dB and the simulated phase difference falls within a range of from −0.24° to 0.78° when the frequency of the input signal (P1) (see FIG. 7) falls within a range of from 0 GHz to 40 GHz.

Referring back to FIG. 3, in view of the above, in this embodiment, since the physical length of each of the first and second transmission lines 2, 3 is 0.07 to 0.12 times the operation wavelength (λ) of the power divider, and since only two capacitors (i.e., the first and second capacitors 4, 5) are required in the power divider, the power divider has the advantage of occupying a smaller area than the prior arts. In addition, excellent performances of amplitude imbalance and phase difference can be achieved by virtue of the symmetrical layout of the first and second transmission lines 2, 3.

Figure 10:
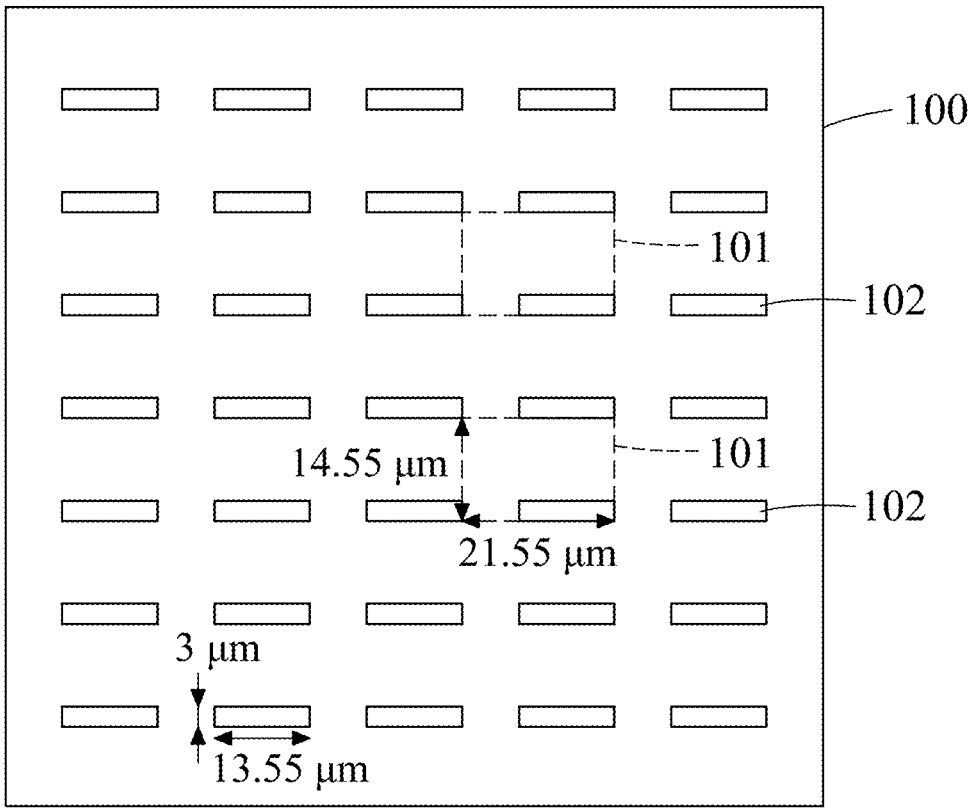
FIG. 10 is a schematic diagram illustrating an exemplary patterned ground of another embodiment of the power divider according to the disclosure.

Referring to FIGS. 3 and 10, in another embodiment, the power divider further includes a patterned ground 100 disposed below the first and second transmission lines 2, 3. For example, when the power divider is fabricated using the aforesaid CMOS process, the first and second transmission lines 2, 3 are formed mainly in the top metal layer, and the patterned ground 100 is formed in a bottom metal layer. The patterned ground 100 is provided with a plurality of unit regions 101, and a plurality of slots 102 respectively in the unit regions 101. For example, each of the unit regions 101 is rectangular and has a length of 21.55 μm and a width of 14.55 μm, and each of the slots 102 is rectangular and has a length of 13.55 μm and a width of 3 μm. The patterned ground 100 can effectively suppress eddy current loss of the bottom metal layer and energy loss of a substrate when the power divider is fabricated using the CMOS process.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that the disclosure is not limited to the disclosed embodiment but is intended to cover various arrangements included within the spirit and scope of the broadest interpretation so as to encompass all such modifications and equivalent arrangements.

What is claimed is:

1. A power divider configured to operate at an operation frequency, and comprising:

a first transmission line having a first terminal, a second terminal, and a physical length that is 0.07 to 0.12 times an operation wavelength of said power divider, the operation wavelength of said power divider corresponding to the operation frequency;

a second transmission line having a first terminal, a second terminal, and a physical length that is 0.07 to 0.12 times the operation wavelength of said power divider, said second transmission line being disposed adjacent to and spaced apart from said first transmission line so as to establish electromagnetic coupling with said first transmission line;

said first terminals of said first and second transmission lines being connected together, and being to receive an input signal;

a first capacitor having a first terminal that is connected to said first terminals of said first and second transmission lines, and a second terminal; and a second capacitor and a resistor connected in parallel between said second terminals of said first and second transmission lines;

said second terminals of said first and second transmission lines being to respectively provide two output signals which are in-phase, and each of which has a frequency equal to that of the input signal.

2. The power divider of claim 1, wherein said first capacitor has a capacitance twice that of said second capacitor.

3. The power divider of claim 1, wherein said second terminal of said first capacitor is connected to ground.

4. The power divider of claim 1, wherein said first and second transmission lines are substantially coplanar.

5. The power divider of claim 1, wherein said first and second transmission lines have the same width.

6. The power divider of claim 1, wherein each of said first and second transmission lines is configured as a spiral.

7. The power divider of claim 6, wherein each of said first and second transmission lines is configured as an octagonal spiral.

8. The power divider of claim 6, wherein each of said first and second transmission lines is configured as a rectangular spiral.

9. The power divider of claim 6, wherein said second transmission line is interwound with said first transmission line.

10. The power divider of claim 6, wherein said first and second transmission lines are line-symmetrical with each other.

* * * * *